US011293730B1

(12) United States Patent
Burke

(10) Patent No.: US 11,293,730 B1
(45) Date of Patent: Apr. 5, 2022

(54) BULLET PROJECTILE WITH ENHANCED MECHANICAL SHOCK WAVE DELIVERY FOR WARFARE

(71) Applicant: Douglas Burke, Newport Beach, CA (US)

(72) Inventor: Douglas Burke, Newport Beach, CA (US)

( * ) Notice: Subject to any disclaimer, the term of this patent is extended or adjusted under 35 U.S.C. 154(b) by 0 days.

(21) Appl. No.: 15/731,555

(22) Filed: Jun. 23, 2017

Related U.S. Application Data

(60) Provisional application No. 62/392,902, filed on Jun. 14, 2016.

(51) Int. Cl.

| | |
|---|---|
| ***F42B 12/06*** | (2006.01) |
| ***F42B 12/74*** | (2006.01) |
| ***F42B 12/16*** | (2006.01) |
| *F42B 30/02* | (2006.01) |

(52) U.S. Cl.
CPC ..... *F42B 12/16* (2013.01); *F42B 12/06* (2013.01); *F42B 12/74* (2013.01); *F42B 30/02* (2013.01)

(58) Field of Classification Search
CPC ..... F42B 12/06; F42B 12/16; F42B 12/362; F42B 12/56; F42B 12/74
See application file for complete search history.

(56) References Cited

U.S. PATENT DOCUMENTS 1,179,686 A * 4/1916 van Kampen ..... F42B 12/06 102/518
2,391,303 A * 12/1945 Field ..... F42B 12/204 102/500
3,040,661 A * 6/1962 Ross ..... F42C 13/02 102/213
3,496,869 A * 2/1970 Engel ..... F42B 14/064 102/522
3,795,196 A * 3/1974 Hillenbrand ..... F42B 12/06 102/518
3,820,463 A * 6/1974 Leonard et al. ..... F42B 30/04 102/436
4,559,876 A * 12/1985 Bocker ..... F42B 10/46 102/501
6,286,433 B1 * 9/2001 Borg ..... F42B 12/06 102/516
8,661,980 B1 * 3/2014 Roemerman ..... F42B 12/207 102/489

FOREIGN PATENT DOCUMENTS

EP 1447642 A1 * 8/2004 ..... F42B 12/06

* cited by examiner

*Primary Examiner* — Jonathan C Weber

(57) ABSTRACT

A bullet projectile is described wherein an internal cylindrical sliding mechanical hammer mechanism provides secondary impact improving overall effectiveness in delivering a mechanical shock wave to a target.

7 Claims, 11 Drawing Sheets

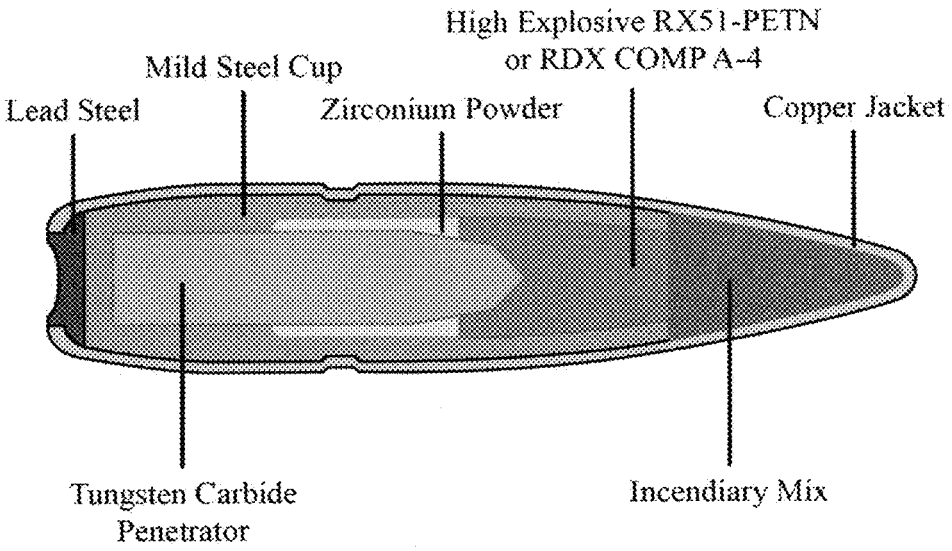
Figure 0 (PRIOR ART)
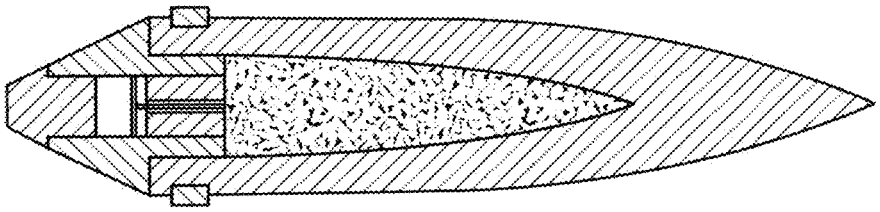
Figure 0-a (PRIOR ART)

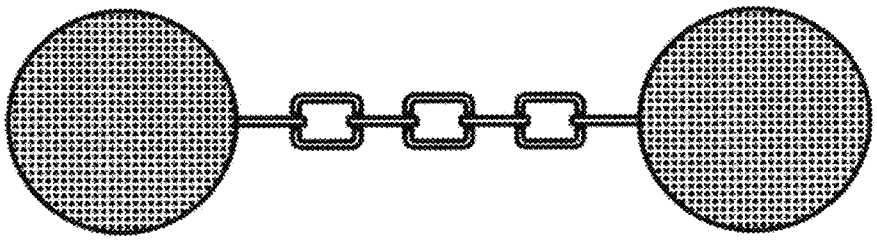
Figure 0-b (PRIOR ART)
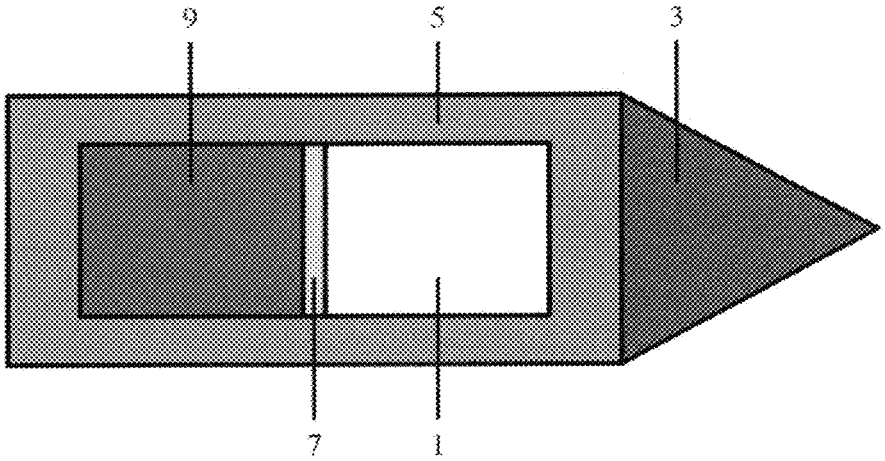
Figure-1

BULLET PROJECTILE WITH ENHANCED MECHANICAL SHOCK WAVE DELIVERY FOR WARFARE

BACKGROUND OF THE INVENTION

The proposed invention is in the field of bullets and projectiles for warfare. This invention is a formal application based on the provisional application No. 62/392,902 previously filed 14 Jul. 2016. In its mode of operation, it is related to double impact bullet systems. In the prior-art the simplest double impact bullet system would be two projectiles tethered together by a string. The proposed invention in its first mode is an improved double impact bullet system.

A modern double impact system is a bullet that explodes upon impact with the target to enhance its penetrating ability. A good description for a modern exploding bullet is given on Wikipedia and that example is used here with a different description than is on Wikipedia. Nonetheless the basic elements of the prior art can be taught and explained with this example. (see: https://en.wikipedia.org/wiki/High-explosive_incendiary/armor-piercing_ammunition)

High-explosive incendiary/armor-piercing ammunition (HEIAP) is a form of shell which combines armor-piercing capability and a high-explosive effect. In this respect, it is a modern version of an armor-piercing shell.

Typical of a modern HEIAP shell is the Raufoss Mk 211 .50 BMG round designed for weapons such as heavy machine guns and anti-materiel rifles. This round is pictured in FIG. 0. It is as good an example to use as any other since all these exploding bullets have the same basic elements. Also referring to FIG. 0*a* is an early version of an exploding bullet to Holmblad 8 Aug. 1900 U.S. Pat. No. 726,291. This has initial impact upon collision and secondary shock waves due to its explosion. An even earlier version of a multiple impact bullet would be the tethered musket balls or cannon balls referred to in FIG. 0*b*. These were used to impart damage to ships rigging and masts.

The modern bullet that uses an internal penetrator with an incendiary and explosive is the Raufoss Mk 211 which as already stated is a .50 caliber (12.7×99 mm NATO) multipurpose anti-materiel projectile produced by Nammo (Nordic Ammunition Group, a Norwegian/Finnish military industry manufacturer of ammunition), under the model name NM140 MP. It is commonly referred to as simply multipurpose or Raufoss, which refers to Nammo's original parent company: Raufoss Ammunisjonsfabrikker (Ammunition Factory) in Raufoss, Norway, established in 1896. The "Mk 211" name comes from the nomenclature "Mk 211 Mod 0" used by the U.S. military for this round. The bullet is designed to explode on impact and clear the way for the penetrator to pierce armor.

The proposed invention is a novel double impact bullet with an internal hammer that delivers a mechanical kinetic phenomenon superior to previous double or multiple impact systems. The internal hammer kinetic action of the proposed invention within the body of the bullet is absent in the prior art and is the reason for the advantages of the proposed invention.

BRIEF DESCRIPTION OF THE DRAWINGS

FIG. 0 Modern exploding bullet design with penetrator

FIG. 0*a* Exploding bullet of Holblad from 1900

FIG. 0*b* Tethered musket balls for double impact

FIG. 1 Basic Design with internal hammer and pointed nose cone

Figure 2:
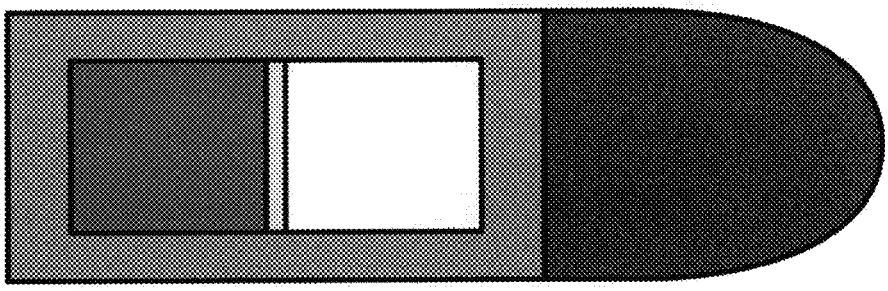
FIG. 2 Basic Design with internal hammer and round nose cone

OBJECTS AND ADVANTAGES (1) The proposed invention is an improved double impact bullet.

(2) The proposed invention can be used to generate a spherical shock wave of extremely high pressure to further the damage to armor beyond what was previously possible.

(3) The proposed invention has a unique sliding internal mechanical hammer which slides with close tolerance inside the fuselage providing a concise short rise time shock wave pulse previously unachievable by any other projectile device.

DETAILED DESCRIPTION OF THE INVENTION

The invention has many mechanical modes and they will be described in an order that teaches the reader the essence of the technology. In all the modes of the proposed invention it is assumed that the reader is skilled in the art and that it is obvious how to get the projectile into flight from an explosive gun powder or its equivalent in a firearm. It is also assumed that a full metal copper jacket would cover each of the structures shown in all of the modes of the invention. The full metal copper jacket is left out of the description and is absent from the drawings. Terminology from rocketry science is used since it seems like the terms are a natural way to describe the technology. These terms are specific to the proposed invention and their meanings are not identical to the way they are used in rocketry but they are however close. For example, a nose cone in rocketry is a separate and distinct embodiment from the fuselage but for the proposed invention they may be considered a single embodiment depending on whether they are made of different materials.

Referring to FIG. 1 what is shown are the basic embodiments of the first mode of the proposed invention. It consists of an empty internal space (1), a nose cone (3), a fuselage (5), a Hammer retaining mass spacer (7), and an internal Hammer (9). The hammer is inherently internal and will be referred to as the hammer without further use of the adjective internal. The operation of the first mode comprises the following. After the bullet is in flight it will fly towards its target. Upon impact with the target the nose cone and fuselage will experience a shock wave of first mechanical impact. Because of Newton's second law, due to the deceleration of the center of mass of the system the hammer will be forced forward towards the nose cone. As the hammer is forced forward the hammer retaining spacer is designed to break and allow the hammer to move forward within the fuselage. Alternatively, the hammer could be tethered to the rear of the fuselage. The tether would be a string which would break upon impact as the hammer is forced forward. The nose cone can be made large enough and massive enough to allow the hammer enough time to move through the fuselage before the fuselage suffered fracture which would immobilize the hammer. Thus upon first impact the nose cone would be designed to undergo a plastic deformation that would absorb the initial shock wave thereby protecting the fuselage from damage giving the hammer enough time to move through the interior of the fuselage. The hammer would thus be forced through the nose cone and into the target providing a secondary impact to the target. It is desirable that the hammer have more mass than the mass of the sum of the remaining parts. To achieve this end the nose cone would be made from lead. The fuselage would be made from ceramic. The hammer would be made from Lead, Uranium, Tungsten, Gold, Platinum, Mercury, Iridium or other high-density alloys. Depleted uranium would be fine since there is no advantage to it being not depleted. These choices of materials would allow the bullet to function upon impact. The desired mechanical effects are that the initial blow causes plastic deformation in the nose cone. The first shock wave is thus slowed down by the plastic deformation. The hammer is forced forward in the rigid structure of the fuselage. The hammer makes the secondary impact with the target. The first mode of the proposed invention is thus a double impact bullet. The first impact serves to soften the target by way of kinetic energy being converted into heat. The second impact of the hammer serves to deliver the penetrating blow to the target. The retaining spacer can be absent since upon acceleration of the bullet from the barrel the hammer is forced to the rear of the fuselage. With no retaining spacer as the bullet slows in flight the hammer can start to drift forward. For close range the retaining spacer can be absent with almost no loss of function.

Figure 3:
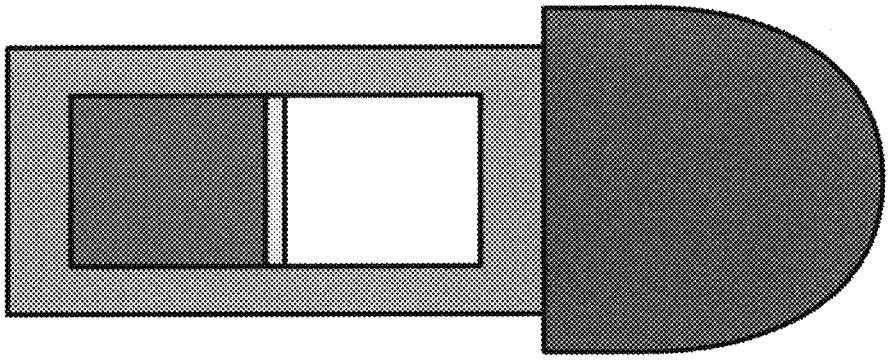
FIG. 3 Design with over-size round nose cone

Referring to FIG. 2 what is shown is another version of the first mode of the invention with all the same basic elements as those found in FIG. 1. The only difference is that there is a geometric difference in the design of the nose cone. Thus, all the adjustments in shape that are made in bullets in general can be made to the bullet projectiles of the proposed invention Referring to FIG. 3 what is shown is another version of the first mode of the invention with all the same basic elements as those found in FIG. 1. The only difference is that there is a geometric difference in the design of the nose cone. Here the nose cone has a larger diameter than the fuselage. In this design the nose cone is designed to have more mass than the hammer and the remaining parts. This bullet looks more like a dart. The advantage to this design of mode one of the proposed invention is evident when we discussed the materials and their properties. The hammer is Uranium and it is not involved in the first impact directly. The nose cone is made of lead which has a relatively low specific heat. The nose is relatively flat so the bullet is not designed to penetrate. The nose cone will however get relatively hot on impact and deform around the sides of the fuselage. This will spread kinetic energy around the fuselage and protect it from getting damaged so there is time for the hammer to move inside the fuselage and deliver the secondary impact.

Figure 4:
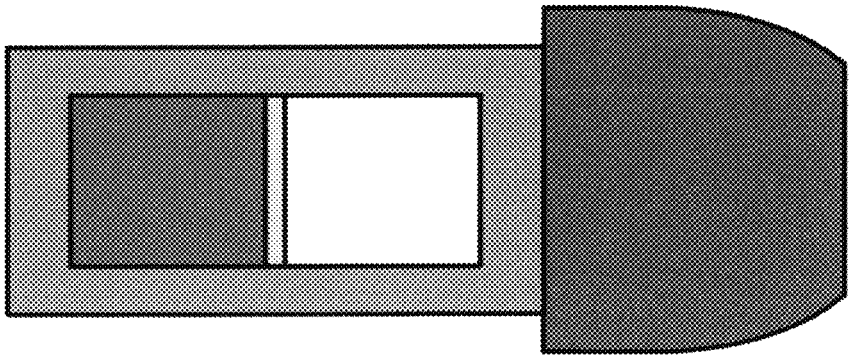
FIG. 4 Design with over-size flat nose cone

The heating of the nose cone on impact can be further enhanced by the design shown in FIG. 4. Referring to FIG. 4 the flattening of the nose cone will further reduce the penetration depth and speed up the loss of kinetic energy of the projectile and its corresponding conversion into heat. Heat that will raise the temperature of the nose cone and deform it around the fuselage.

Figure 5:
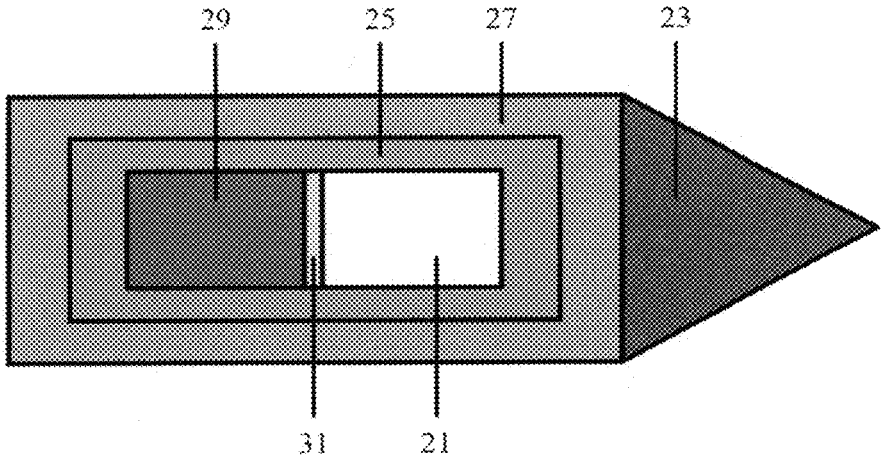
FIG. 5 Design with additional exterior fuselage and pointed nose cone

Another design of mode one of the proposed invention can be found in FIG. 5. Referring to FIG. 5 what is shown is an empty internal space (21), a nose cone (23), an inner fuselage (25), an outer fuselage (27), an internal Hammer (29), and a Hammer retaining mass spacer (31). The advantage of this design is that the outer fuselage further protects the structural integrity of the inner fuselage. A choice of materials would: Inner fuselage should be made of ceramic or a very stiff metal like Beryllium or spring steel. The outer fuselage should be made of copper or lead. The nose cone should be made of copper or lead. The Hammer should be made of Uranium or Tungsten or any other high density metal.

Figure 6:
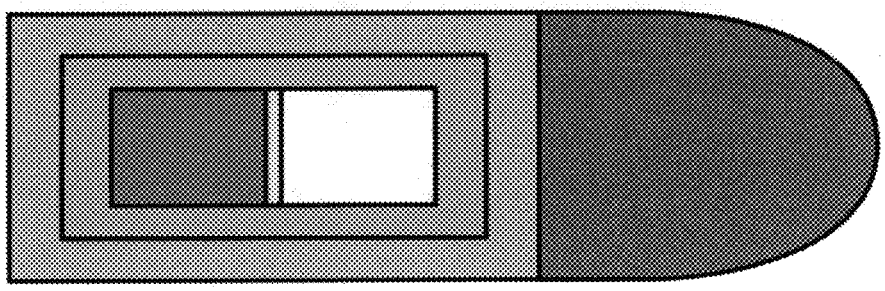
FIG. 6 Design with additional exterior fuselage and round nose cone
Figure 7:
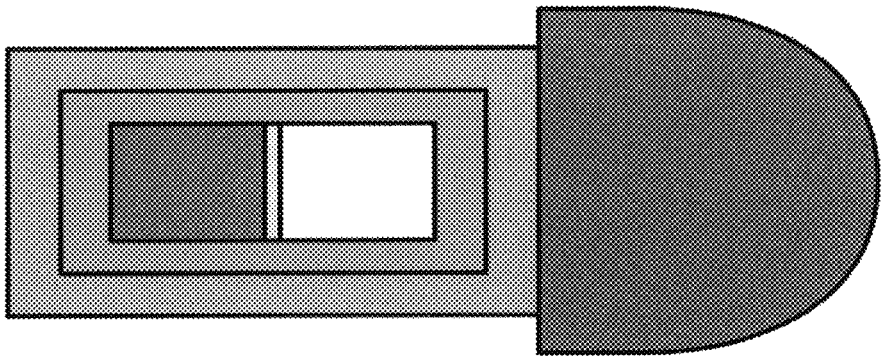
FIG. 7 Design with additional exterior fuselage and over-sized round nose cone FIG. 8 Design with additional exterior fuselage and oversized flat nose cone FIG. 9 Exploding design with pointed nose cone FIG. 10 Exploding design with compound pointed nose cone FIG. 11 Exploding design with round nose cone and internal shrapnel FIG. 12 Exploding design with flat nose cone and internal shrapnel FIG. 13 Exploding design with conic fuselage FIG. 14 Exploding design with conic fuselage and oversized round nose cone FIG. 15 Exploding design with conic fuselage and oversized flat nose cone FIG. 16 Exploding design with conic fuselage and oversized compound flat nose cone FIG. 17 Exploding design with conic fuselage and oversized compound pointed nose cone
Figure 8:
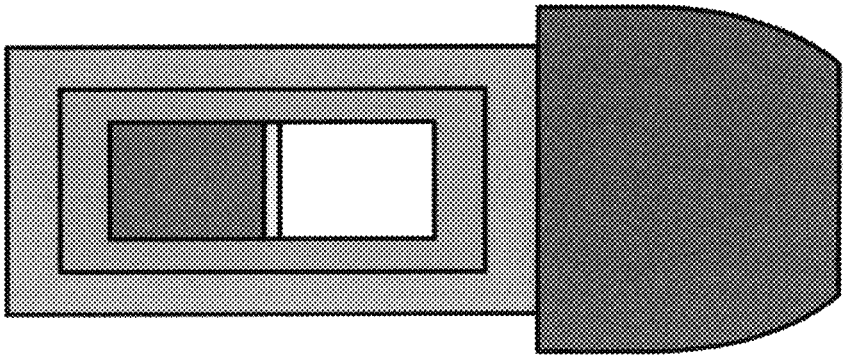

Referring to FIGS. 6, 7, & 8 what is shown are different nose cone designs on the double fuselage design of FIG. 5. These nose cone designs have the advantages already cited earlier.

The void space in the earlier versions of the bullet can be filled with an explosive material. The materials used would be self-detonating or be mixed with a detonating material. Whatever the chemical of mixture of chemicals they must be made so as to explode when the bullet strikes the target and the hammer is slammed forward towards the nose cone. Thus the thermal mechanical shock wave caused by the action of the hammer needs to be sufficient to cause the explosive material to explode. The explosive material needs to be material that explodes without the aid of oxygen or other external catalysts because the explosive material is confined within the space between the hammer and the nosecone within the fuselage. Such materials are selected from the group consisting of the family of plastic explosives. Pentaerythritol Tetranitrate (PETN) and Cyclotrimethylenetrinitramine (RDX) are examples of materials that will work.

Figure 9:
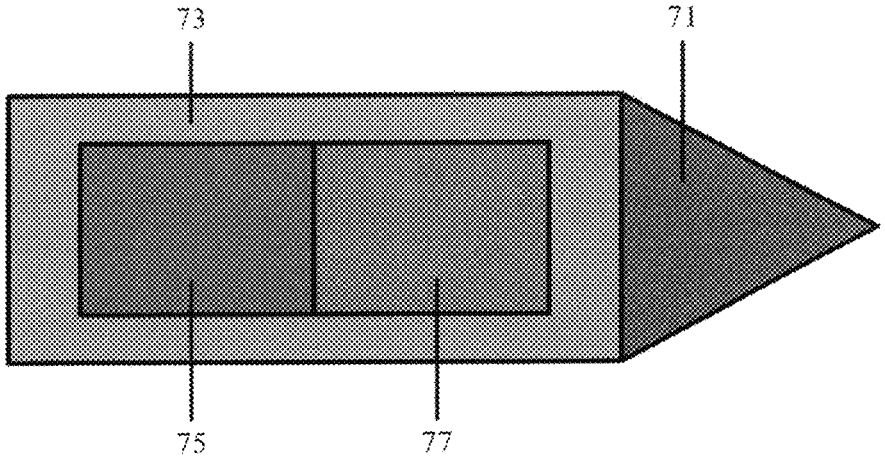
Figure 10:
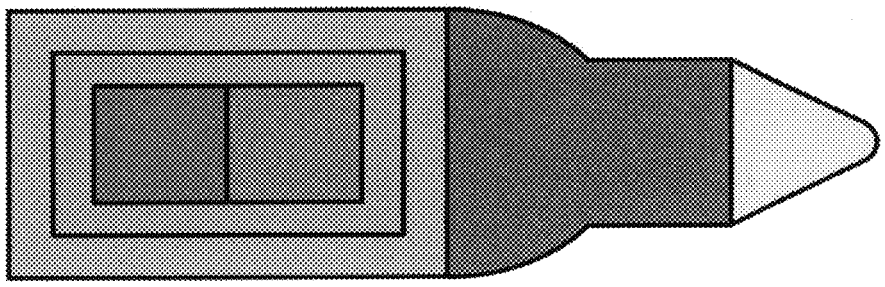
Figure 11:
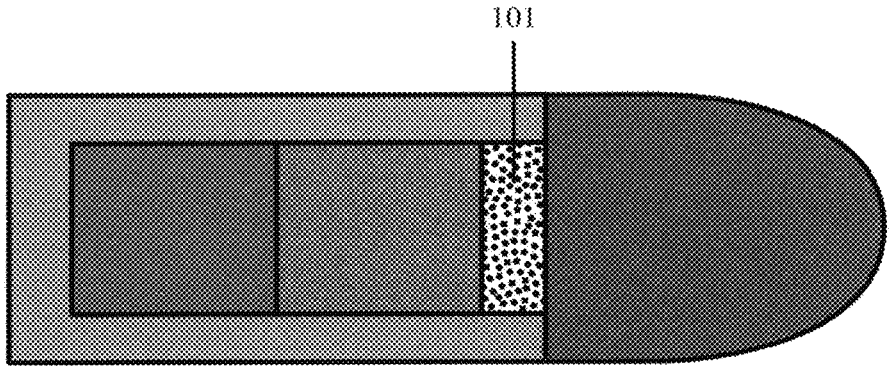
Figure 12:
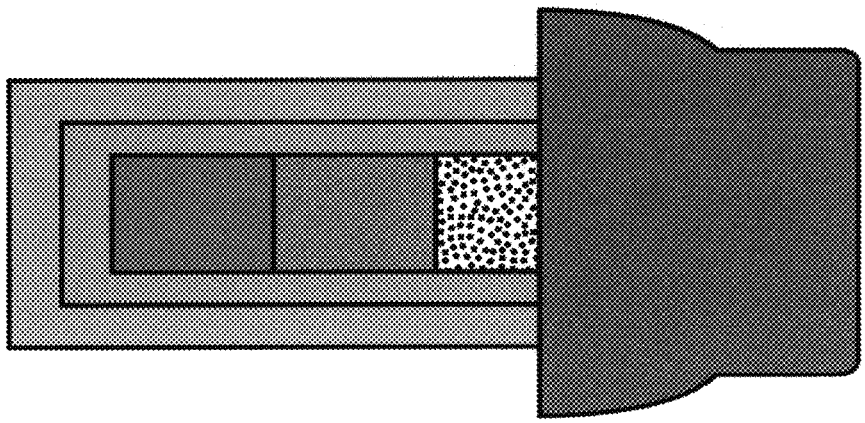
Figure 13:
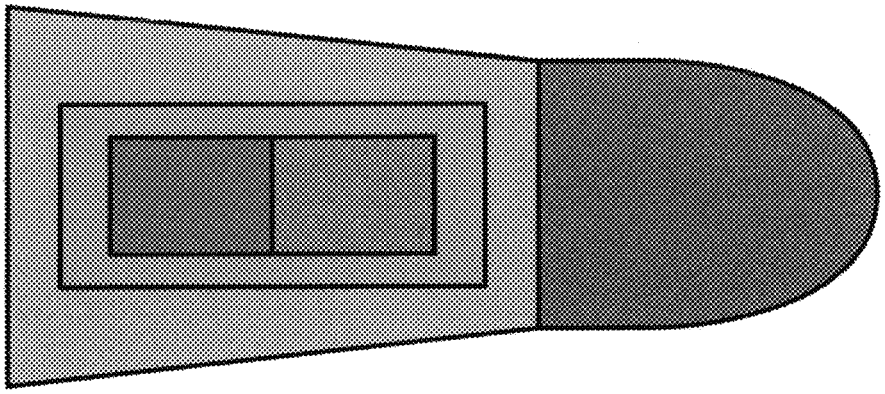
Figure 14:
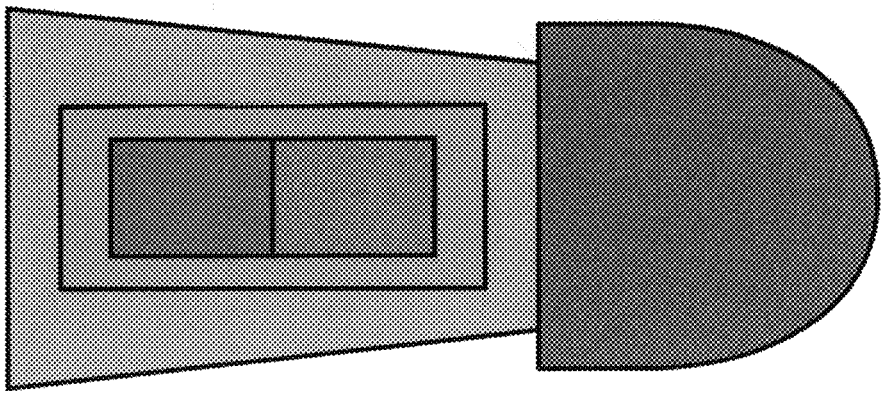
Figure 15:
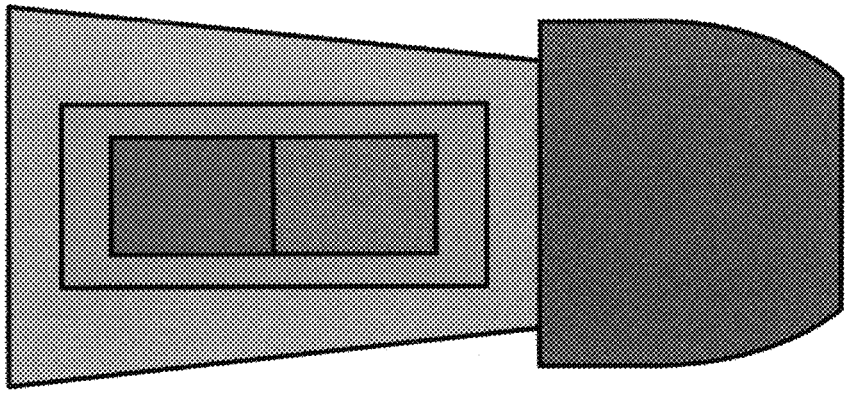
Figure 16:
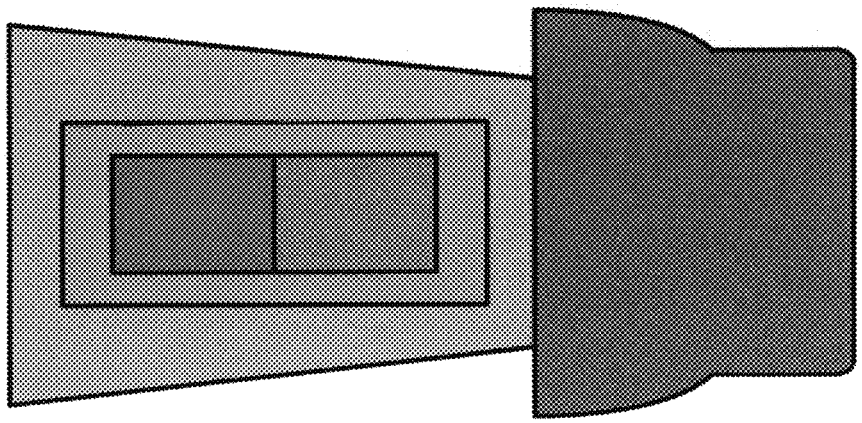
Figure 17:
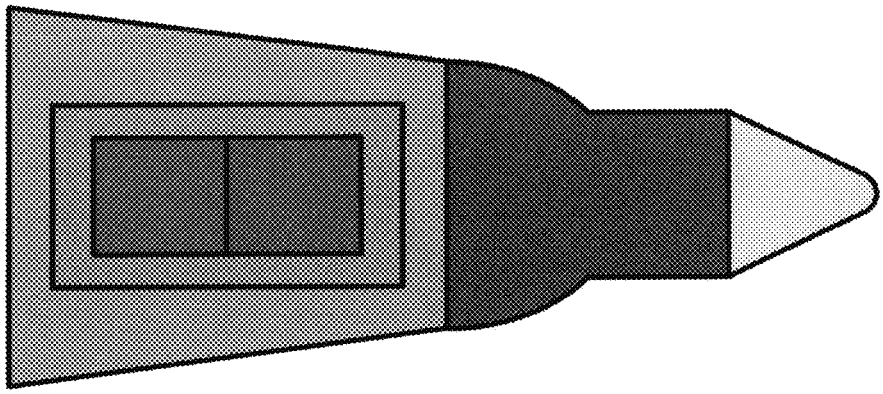

Referring to FIG. 9 is an exploding bullet design with a fuselage (73) an internal hammer (75) a nose cone (71) and an explosive material (77).

Referring to FIGS. 10-17 are a plurality of different designs which can be made in the mechanical mode or the explosive mode.

CONCLUSIONS RAMIFICATIONS AND SCOPE

The above disclosed is a bullet system which in its mechanical mode is simply a double impact bullet with an internal Hammer mechanism. The invention is broad with many more permutations than have been discussed and is not to be judged on the specification but rather on the scope of the claims that follow.

What is claimed is:

1. A non-explosive projectile, comprising:

A rear end and a front end, a closed hollow internal cylindrical fuselage having a fuselage inner diameter, a fuselage outer diameter, an internal fuselage length, and an external fuselage length extending from the rear end toward the front end, a nose cone having a tip and a base, the tip provided at the front end and extending toward the rear end with the base, the base of the nose cone fixed to the closed hollow cylindrical internal fuselage, a solid cylindrical hammer having a hammer length being less than the internal fuselage length, a hammer diameter being less than the fuselage inner diameter, the hammer being positioned within the closed hollow internal cylindrical fuselage, a gap between the end of the closed hollow internal cylindrical fuselage and the hammer, and the hammer configured to slide within the closed hollow internal cylindrical fuselage during acceleration and deceleration of the projectile, and further comprising a closed hollow external cylindrical fuselage directly adjacent to and surrounding the closed hollow internal cylindrical fuselage.

2. The projectile of claim 1, wherein said hammer is composed of a material selected from the group consisting of lead, uranium, tungsten, gold, platinum, mercury, or iridium.

3. The projectile of claim 1, wherein said fuselage is composed of ceramic, and said nose cone is composed of copper.

4. The projectile of claim 1, wherein said nose cone is rounded.

5. The projectile of claim 1, further comprising a retaining structure within the closed hollow cylindrical fuselage, the retaining structure being a wall or ridge adjacent to the hammer to retain the hammer prior to impact.

6. The projectile of claim 1, wherein said hammer is composed of lead, said fuselage is composed of ceramic, and said nose cone is composed of copper.

7. The projectile of claim 1, wherein said nose cone is pointed.

* * * * *